US012507789B2

(12) United States Patent
Assar

(10) Patent No.: US 12,507,789 B2
(45) Date of Patent: Dec. 30, 2025

(54) MULTIPURPOSE TRANSFORMABLE BAG

(71) Applicant: Rishi Assar, Boulder, CO (US)

(72) Inventor: Rishi Assar, Boulder, CO (US)

(73) Assignee: Rishi Assar, Dallas, TX (US)

( * ) Notice: Subject to any disclaimer, the term of this patent is extended or adjusted under 35 U.S.C. 154(b) by 0 days.

(21) Appl. No.: 18/636,170

(22) Filed: Apr. 15, 2024

(65) Prior Publication Data

US 2024/0341458 A1 Oct. 17, 2024

Related U.S. Application Data

(60) Provisional application No. 63/458,944, filed on Apr. 13, 2023.

(51) Int. Cl.
*A45F 4/02* (2006.01)

(52) U.S. Cl.
CPC ..... *A45F 4/02* (2013.01); *A45F 2004/023* (2013.01)

(58) Field of Classification Search
CPC .... A45F 4/02; A45F 2004/023; A45C 7/0063; A45C 7/0068; A45C 7/0072
USPC ..... 224/577, 153; 383/2; 190/103
See application file for complete search history.

(56) References Cited

U.S. PATENT DOCUMENTS 2,729,257 A * 1/1956 Kepper ..... A45C 7/0068 383/2
4,078,595 A * 3/1978 Mittelmann ..... A45C 7/0063 150/112
4,236,615 A * 12/1980 Ginat ..... A45C 7/0068 383/41
4,613,039 A 9/1986 Shaw et al.
7,178,567 B2 * 2/2007 Mangano ..... A45C 7/0072 150/108
2004/0195286 A1 * 10/2004 Greenhalgh ..... A45C 7/0063 224/653

(Continued)

FOREIGN PATENT DOCUMENTS

GB 2475503 A * 5/2011 ..... A45C 7/0077
KR 940003148 Y1 * 5/1994 ..... A45F 4/02

OTHER PUBLICATIONS https://www.carousell.ph/p/jovanni-invertible-bag-136898975/ (Last accessed Apr. 22, 2024—3 pages).

(Continued)

*Primary Examiner* — Scott T McNurlen
(74) *Attorney, Agent, or Firm* — University of Colorado Law Entrepreneurial Law Clinic

(57) ABSTRACT

Embodiments are directed to a reversible bag including a first fabric assembly defining an outer surface, an inner surface, and a first volume. The outer surface includes a first fastening location, a second fastening location, and at least two closing mechanisms. The second fabric assembly is coupled to the inner surface and includes a second larger volume. The second fabric assembly includes top and bottom surfaces and can be inserted through at least two closing mechanisms. The reversible bag includes at least one strap that includes a first end coupled with the first fastening location on the outer surface and a second end coupled with the second fastening location of the outer surface. The reversible bag includes a first bag wing coupled to the outer surface adjacent to the first fastening location and a second bag wing coupled to the outer surface adjacent to the second fastening location.

1 Claim, 5 Drawing Sheets

(56) References Cited

U.S. PATENT DOCUMENTS

| | | | | |
|---|---|---|---|---|
| 2006/0102673 | A1* | 5/2006 | Collier | A45C 7/0068 190/103 |
| 2013/0074998 | A1* | 3/2013 | McMonigle | A45C 13/26 150/107 |
| 2022/0378178 | A1 | 12/2022 | Cope et al. | |
| 2023/0117701 | A1* | 4/2023 | Tardio | A45C 7/0022 190/103 |

OTHER PUBLICATIONS https://www.spencersonline.com/product/flip-pak-kirby-reversible-backpack/248293.uts (Last accessed Apr. 22, 2024—4 pages).

* cited by examiner

MULTIPURPOSE TRANSFORMABLE BAG

CROSS REFERENCE

This application claims the benefit of U.S. Provisional Patent Application No. 63/458,944, filed on Apr. 13, 2023, the contents of which are herein incorporated by reference in their entirety.

TECHNICAL FIELD

Embodiments of the present disclosure generally relate to bags and soft goods that can be used to carry various items; and more specifically relate to a bag that can be transitioned between multiple configurations to change a carrying capacity, functions, and/or style of the bag.

BACKGROUND

Individuals often use bags, purses, slings, or other soft goods to store and carry various items. For example, someone could use a fanny pack, shoulder bag, or sling bag to store and secure items such as a wallet, phone, currency, passport, or other valuables, during routine trips every day, while commuting, or while traveling. Bags or soft goods may come in different shapes and sizes, such as backpacks, tote bags, and fanny packs. These bags or soft goods have closing mechanisms like zippers, hook and loops, and other forms of closures to allow items to be inserted and removed from the bag or soft good.

SUMMARY

This disclosure includes a reversible bag, which in some embodiments includes a bag that is worn across the body as a cross-body bag or over the shoulder as a satchel.

In some embodiments, the reversible bag is comprised of an outer fabric pouch with two closing mechanisms, and an inner fabric pouch coupled to the interior surface of the outer fabric pouch. The two closing mechanisms allow access to the top interior chamber and bottom interior chamber of the outer fabric pouch.

In some embodiments, a third closing mechanism is coupled to the outer surface of the outer fabric assembly. In some embodiments, the third closing mechanism opens to a separate side compartment.

In some embodiments, the interior fabric pouch of the bag is expanded through the first closing mechanism to create an expanded volume. The expanded bag opens and closes using the second closing mechanism.

In some embodiments, the interior pouch of the bag is expanded through the second closing mechanism to create an expanded volume. The expanded bag opens and closes using the first closing mechanism.

In some embodiments, the third closing mechanism is on the exterior of the expanded bag, and is opened and closed without the first closing mechanism or second closing mechanism being opened.

In some embodiments, the expanded volume is inverted, covering the outer fabric pouch and the closing mechanisms.

In some embodiments, the first closing mechanism is closer to the top of the inverted expanded volume, and can open and close the inverted expanded volume. In some embodiments, the second closing mechanism is closer to the top of the inverted expanded volume, and can open and close the inverted expanded volume.

In some embodiments, the third closing mechanism is on the interior of the inverted expanded bag, and is opened and closed when the first closing mechanism or second closing mechanism is open.

In some embodiments, the strap is a flat material that can be connected at both ends of the outer surface of the outer fabric assembly. Alternatively, the straps can be connected to wings, and these wings are connected to the outer surface of the outer fabric assembly. The connection points between the outer surface can be symmetric, but in some embodiments, they are not. In some embodiments, one end of the strap can be connected by a rope loop. In another embodiment, one end of the strap can include a release buckle. In some embodiments, the strap can include a slide bar that allows for the strap to adjust in length.

DETAILED DESCRIPTIONS

Figure 1:
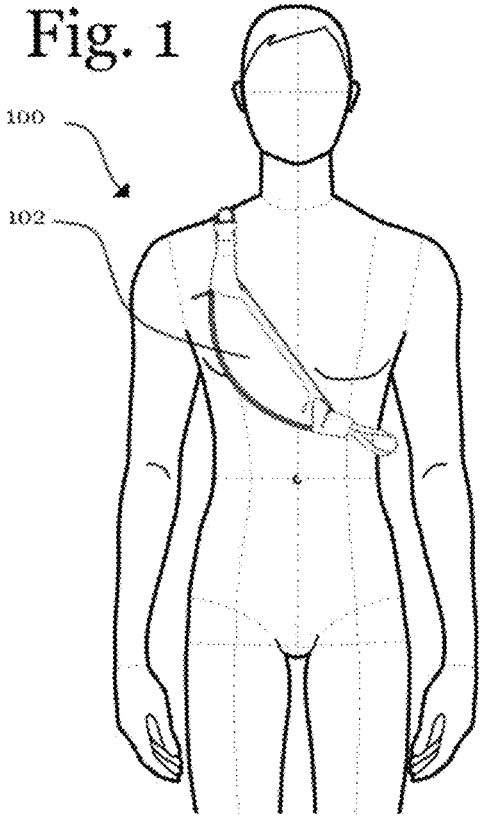
FIG. 1 shows an embodiment of the reversable bag being worn as a cross-body sling.

FIG. 1 shows an embodiment of the reversible bag 102 being worn in a cross-body configuration. In some embodiments, selective openings of closing mechanisms permit the reversible bag 102 to be converted from a cross-body configuration 100 into other configurations.

Figure 2:
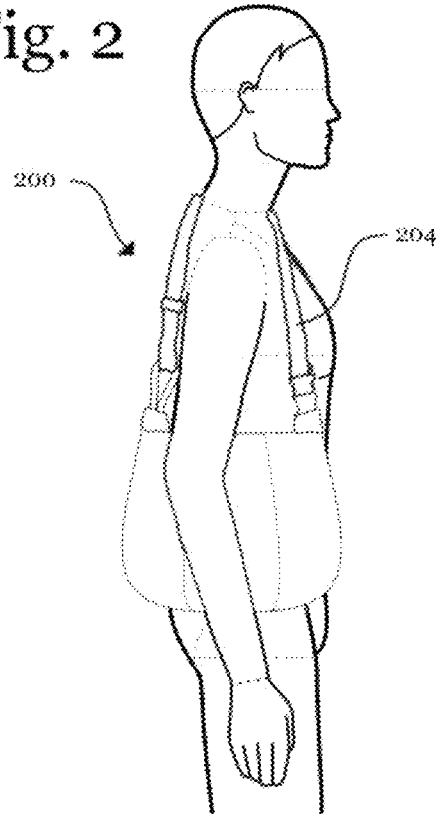
FIG. 2 shows an embodiment of the reversable bag where the reversable bag has been expanded and reversed and is being worn as an across the shoulder satchel.

FIG. 2 shows the embodiment of FIG. 1 in which a strap 204 has been adjusted to be worn over the shoulder in a satchel configuration. In some embodiments, selective openings of closing mechanisms permit the reversible bag 102 to be converted from a satchel configuration 200 into other configurations.

Figure 3:
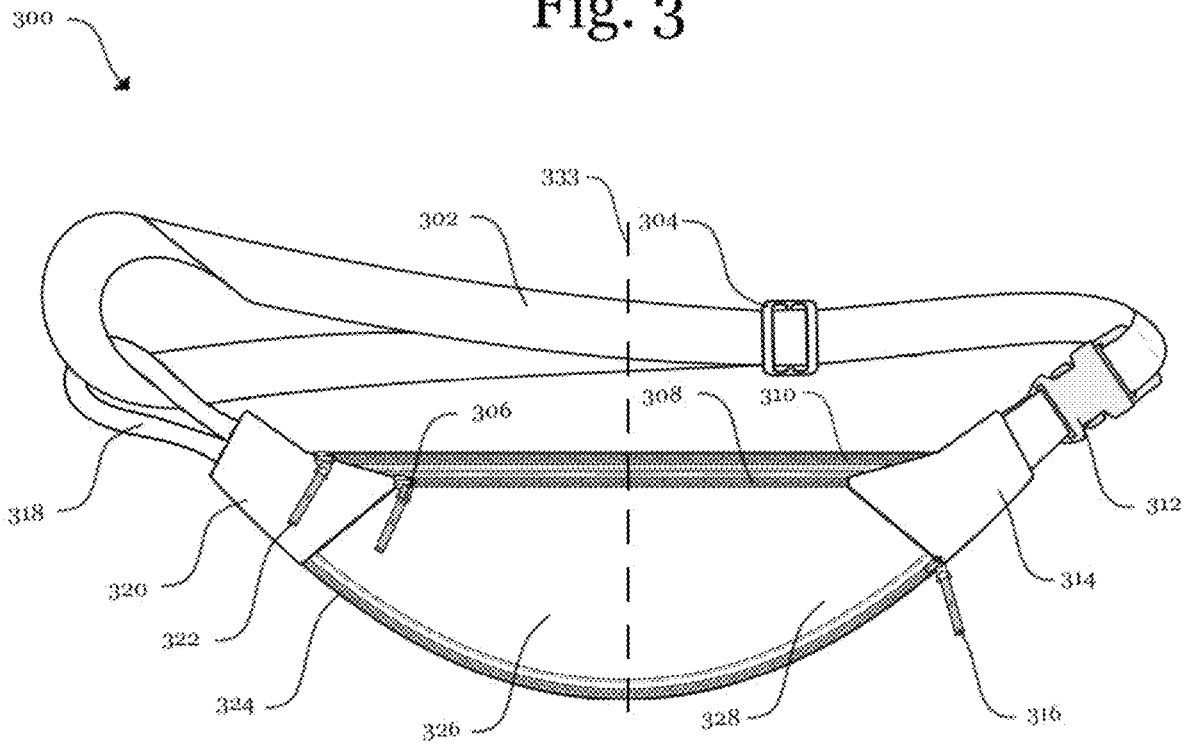
FIG. 3 shows the bag in a closed configuration with both closing mechanisms exposed. A third closing mechanism is also present on the exterior surface of the outer fabric pouch.

FIG. 3 shows the reversible bag 102 in a closed configuration. In one embodiment, the closed configuration 300 includes an outer fabric pouch 328. A first closing mechanism 310 and a second closing mechanism 324 are coupled to the outer surface 326 of the outer fabric pouch 328. This closed configuration allows the reversible bag 102 to hold items. The first closing mechanism 310 and second closing mechanism 324 allow access to the interior chambers 606 and 614 to store and secure items inside the reversible bag 102. The closing mechanisms 310 and 324 could be a zipper, a Velcro system, a hook and loop, or another form of closure. In one embodiment of the disclosure, the first closing mechanism 310 could have a zipper pull 322 that could be used to open the closed configuration 300, and the second closing mechanism 324 could have a second zipper pull 316 that could be used to open the closed configuration 300.

In one embodiment of the disclosure, a first bag wing 320 and a second bag wing 314 are coupled to the outer surface 326 of the outer fabric pouch 328.

In some embodiments of the disclosure, one or more components of the reversible bag 102 are symmetric about the plane 333. In one embodiment, a strap 302 is attached to the outer fabric pouch 328 at two points on opposite ends of the closing mechanisms 310 and 324, creating symmetry through the plane 333 of the outer fabric pouch 328. In some embodiments, these attachment points for the strap are on wings 314, 320 that are fixed to the bag on opposite ends of the closing mechanisms 310 and 324. In some embodiments, these wings 314 and 320 are attached to the outer fabric pouch 328 and provide an anchor point for the strap ends inside of the wings. In some embodiments, when the bag is expanded, the wings 314 and 320 will point up to allow for easier carrying. In some embodiments, the strap attachment points 318 and 314 are not identical. One attachment point in an embodiment is a circle of rope 318 that the strap 302 would loop through, double-layer onto itself, and then be fixed at some other point along the strap, possibly a slide bar 304. In some embodiments, the circle of rope 318 is made of recycled climbing rope, or some other sturdy material. This circle of rope 318 in an embodiment is long enough and sturdy enough to allow for attachment of other accessories by carabiner. In some embodiments, an attachment point is a hook that is attached to both the outer fabric pouch 328 and one end of the strap 302.

In some embodiments, the attached strap or straps 302 is made of a single piece of material, such as a flat strip of webbed nylon. In other embodiments, the strap is made of a daisy chain of multiple loops of one or more materials connected to each other. In some embodiments, the strap 302 has a slide bar 304 along the strap 302 and extra material 402 so that the length of the strap 302 can be shortened or lengthened. In some embodiments, either one or both ends of the strap 302 have a release buckle 312 to allow easy detachment of the strap 302.

In one embodiment, one end of the strap 302 attaches to the outer fabric pouch 328 by a rope loop 318 coupled to the outer fabric pouch 328. In some embodiments, the rope loop 318 is made of an elastic rope that stretches when pulled. This elasticity allows the bag to be taken on and off easily without having to adjust the length of the strap or straps 302. In one embodiment, two straps are attached to the outer fabric pouch 328. In some embodiments, the first end of one of the straps are attached parallel to the first end of the other strap, and the second end of one of the straps are attached parallel to the second end of the other strap. The strap ends that are placed closer to the first closing mechanism 310 are configured to fit over the shoulders of the user. These parallel straps allow the user to wear the reversible bag 102 as a backpack whether or not the inner fabric pouch is expanded.

In one embodiment of the disclosure, a third closing mechanism 308 is coupled to the outer surface 326 of the outer fabric pouch 328. In some embodiments, the third closing mechanism 308 is located in between the first bag wing 320 and the second bag wing 314. The third closing mechanism is opened to allow access to a side compartment 612 to store smaller items such as keys or loose change when the first closing mechanism 310 and the second closing mechanism 324 are closed. In some embodiments, the third closing mechanism 308 is a zipper, a Velcro system, a hook and loop, or another form of closure. In one embodiment of the disclosure, the third closing mechanism 308 has a zipper pull 306 that allows the bag to open when in the closed configuration 300.

Figure 4:
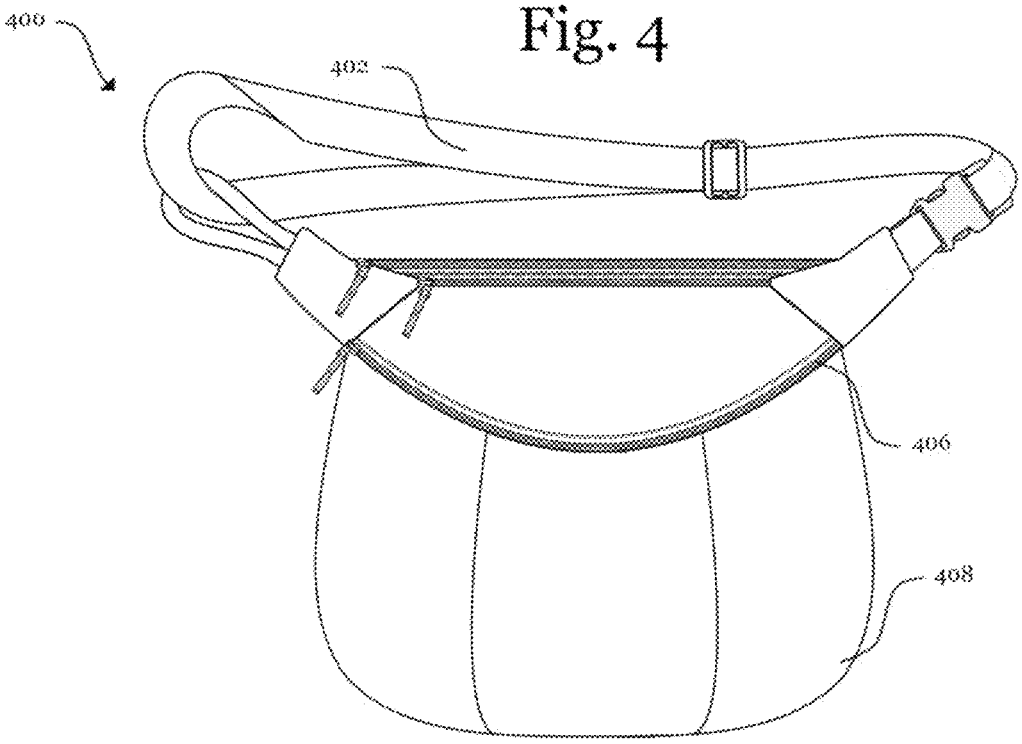
FIG. 4 shows the bag in an expanded configuration with both closing mechanisms exposed. One closing mechanism creates an opening through which the bag expands to an expanded volume, and the other closing mechanism allows the expanded volume to be accessed.

FIG. 4 shows the reversible bag 102 in an expanded configuration 400. In one embodiment of the disclosure, a symmetrical opening 406 allows the interior fabric pouch 408 to expand outwards, creating the expanded configuration 400.

In one embodiment of the disclosure, the second closing mechanism 324 opens to create a symmetrical opening 406 through which the interior fabric pouch 408 extrudes, creating the expanded configuration 400. The bottom surface 620 of the interior fabric pouch 408 becomes the exterior surface of the expanded portion.

In one embodiment of the disclosure, the outer surface 326 of the outer fabric pouch 328 remains exposed when the reversible bag 102 is in the expanded configuration 400, allowing any pattern on the outer surface 326 to be visible and the first closing mechanism 310 on the outer surface 326 to remain exposed. The exposed first closing mechanism 310 allows the bag to be opened without entering the top interior chamber 606 of the bag. The first closing mechanism 310 opens to allow storage and retrieval of items inside the expanded configuration 400 and closes to keep items within the reversible bag 102.

In one embodiment of the disclosure, when the reversible bag 102 is in the expanded configuration 400, the third closing mechanism 308 remains exposed and therefore accessible from the outside without opening the first closing mechanism 310. The exposed third closing mechanism 308 opens to allow storage and retrieval of items inside the expanded configuration 400 and closes to keep items within the reversible bag 102 and/or within a side compartment 612.

In one embodiment of the disclosure, the first closing mechanism 310 opens to create a symmetrical opening 406 through which the interior pouch 408 extrudes, creating an expanded configuration 400. The top surface 622 of the interior fabric pouch 408 becomes the outer surface of the expanded portion.

In one embodiment of the disclosure, the outer surface 326 of the outer fabric pouch 328 remains exposed when the bag is in the expanded configuration 400, allowing any pattern on the outer surface 326 and the second closing mechanism 324 to remain exposed. The second exposed closing mechanism is accessible without entering the bottom interior chamber 614 of the bag. The second closing mechanism 324 opens to allow storage and retrieval of items inside the expanded configuration 400 and closes to keep items within the reversible bag 102.

In one embodiment of the disclosure, when the bag is in the expanded configuration 400, the third closing mechanism 308 remains exposed and so is accessible from the outside without opening the second closing mechanism 324. The exposed third closing mechanism 308 opens to allow storage and retrieval of items inside the expanded configuration 400 and closes to keep items within the reversible bag 102 and/or the side compartment 612.

Figure 5:
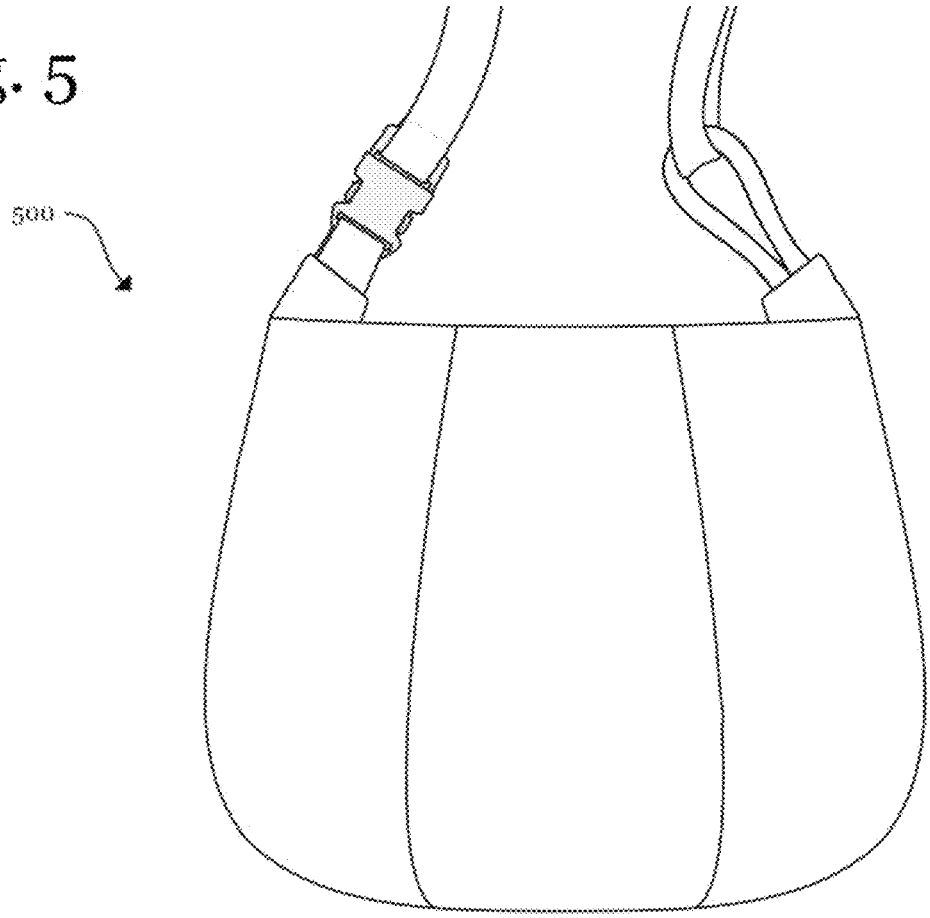
FIG. 5 shows the bag in an inverted expanded configuration with both closing mechanisms covered.

FIG. 5 shows the reversible bag 102 in an expanded reversed configuration 500. In one embodiment of the disclosure, the interior fabric pouch 408 in the expanded configuration 400 inverts through the symmetrical opening 406 created by at least one open closing mechanism 310 or 324 to create a reverse expanded configuration 500.

In one embodiment of the disclosure, the inversion of the interior fabric pouch 408 from the expanded configuration 400 to the reverse expanded configuration 500 exposes the top surface 622 of the interior fabric pouch 408. The outer fabric pouch 328 is completely covered. The first closing mechanism 310 and second closing mechanism 324 are completely covered and accessible via reaching into the larger volume created by the inverted interior fabric pouch 408. The first closing mechanism 310 is located near the top of the expanded reverse configuration 500 and opens and closes to allow items to be stored in the larger volume created by the inverted interior fabric pouch 408.

In one embodiment of the disclosure, when the bag is in the reverse expanded configuration 500, the third closing mechanism 308 is no longer exposed and so is accessible when the first closing mechanism 310 is open.

In one embodiment of the disclosure, the reverse expanded volume 502 exposes the bottom surface 620 of the interior fabric pouch 408. The outer fabric pouch 328 is completely covered. The first closing mechanism 310 and second closing mechanism 324 are completely covered and accessible via reaching into the larger volume created by inverted interior fabric pouch 408. The second closing mechanism 324 is located near the top of the expanded reverse configuration 500 and opens and closes to allow items to be stored in the larger volume created by the inverted interior fabric pouch 408.

In one embodiment of the disclosure, when the bag is in the reverse expanded configuration 500, the third closing mechanism 308 is no longer exposed and so is accessible when the second closing mechanism 324 is open.

Figure 6:
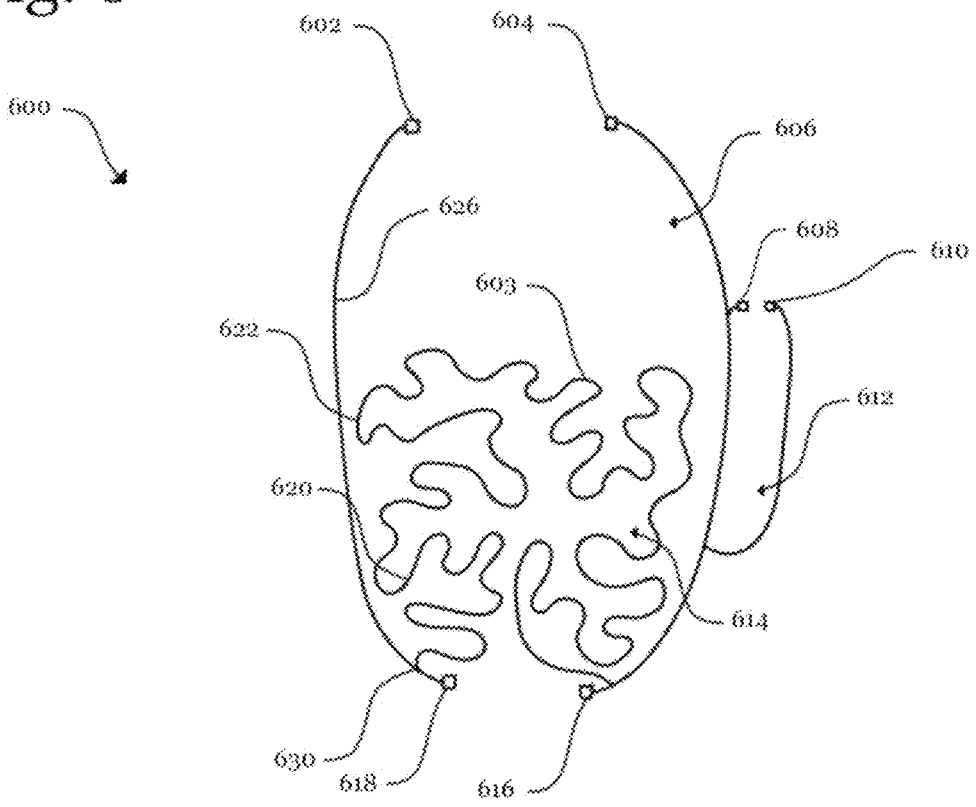
FIG. 6 shows different pouches, surfaces, and closing mechanism locations of some embodiments.

FIG. 6 illustrates a cross-section 600 with the different pouches, surfaces, and closing mechanism locations of some embodiments. The outer fabric pouch 328 has an inner surface 626 and an outer surface area 326. The inner fabric pouch 408 also has an inner surface area 622 and an outer surface area 620, as well as folds 603. One closing mechanism would be attached at one point 602 of the outer fabric pouch 328, and the other side of the closing mechanism would be attached at another point 604 of the outer fabric pouch 328. Another closing mechanism would be attached at one point 618, and then at another point 616. When both closing mechanisms are closed, the bag has two chambers 606 and 614 separated by the inner fabric pouch 408. If the closing mechanism between points 618 and 616 is open, all of the inner fabric pouch 408 can be extended out from between 618 and 616. The third closing mechanism 308 would be attached at one point 608 and another point 610 of the outer fabric pouch 328 and/or the side compartment 612.

In some embodiments, the interior fabric pouch 408 is attached to the inner surface 626 of the outer fabric pouch 328 at a variety of locations. For example, the interior fabric pouch 408 could be coupled to the inner surface 626 at seam 630, which is proximate to an opening between points 616 and 618 (e.g., defined by the second closing mechanism 324). These embodiments expanding the interior fabric pouch 328 through the opening between 616 and 618 may cause the bottom surface 620 to be exposed and the reversible bag 102 to have a larger volume that includes the substantial volume of the interior fabric pouch 408 and the substantial volume of the outer fabric pouch 328. Also, in these embodiments expanding the interior fabric pouch through an opening between points 602 and 604 (e.g., defined by the first closing mechanism 310) would cause the reversible bag 102 to have a smaller volume because a portion of the interior fabric pouch 408 would overlap with a portion of the outer fabric pouch 328. In other cases, the seam 630 or mounting points could be farther within the outer fabric pouch 328 or in other suitable locations.

What is claimed is:

1. A reversible bag, comprising:

a first fabric assembly defining an outer surface and an inner surface and a first volume, the outer surface having a first fastening location, a second fastening location, and at least two closing mechanisms;

a second fabric assembly coupled to the inner surface and defining a second volume greater than at least the first volume, the second fabric assembly comprising a top surface and a bottom surface and configured to be inserted through each of the at least two closing mechanisms;

at least one strap, the at least one strap comprising:

a first end coupled with the first fastening location on the outer surface; and a second end coupled with the second fastening location of the outer surface;

a first bag wing coupled to the outer surface adjacent to the first fastening location;

a second bag wing coupled to the outer surface adjacent to the second fastening location; wherein:

in a first configuration the at least two closing mechanisms are closed and the inner surface and the second fabric assembly are fully covered;

in a second configuration one of the at least two closing mechanisms is opened and the top surface of the second fabric assembly is exposed and the second fabric assembly expanded to the second volume;

in a third configuration the other of the at least two closing mechanisms is opened and the bottom surface of the second fabric assembly is exposed and the second fabric assembly expanded to the second volume; and in a fourth configuration both of the at least two closing mechanisms are open thereby exposing both the top and bottom surfaces of the second fabric assembly.

* * * * *